US009414676B1

(12) United States Patent
Rafii

(10) Patent No.: US 9,414,676 B1
(45) Date of Patent: Aug. 16, 2016

(54) TABLE AND CHAIR WITH SELF-STABILIZING SYSTEM

(71) Applicant: Eddie Rafii, Laguna Niguel, CA (US)

(72) Inventor: Eddie Rafii, Laguna Niguel, CA (US)

( * ) Notice: Subject to any disclaimer, the term of this patent is extended or adjusted under 35 U.S.C. 154(b) by 0 days.

(21) Appl. No.: 14/624,125

(22) Filed: Feb. 17, 2015

Related U.S. Application Data

(63) Continuation-in-part of application No. 14/465,383, filed on Oct. 14, 2014, now abandoned.

(51) Int. Cl.

| | |
|---|---|
| ***A47B 41/04*** | (2006.01) |
| ***A47B 91/16*** | (2006.01) |
| ***A47C 7/00*** | (2006.01) |
| ***A47B 13/00*** | (2006.01) |
| ***A47B 13/02*** | (2006.01) |

(52) U.S. Cl.
CPC ..... *A47B 91/16* (2013.01); *A47B 13/003* (2013.01); *A47B 13/023* (2013.01); *A47C 7/008* (2013.01); *A47B 2013/025* (2013.01)

(58) Field of Classification Search
CPC ..... A47B 9/00; A47B 9/16; A47B 13/023; A47B 2013/025; A47B 2013/026
USPC ..... 108/144.11, 147.19, 147.2, 147.21, 108/150; 248/188.3, 188.5, 188.7
See application file for complete search history.

(56) References Cited

U.S. PATENT DOCUMENTS

| | | | | |
|---|---|---|---|---|
| 2,787,087 | A | 4/1957 | Whitman | |
| 5,513,825 | A * | 5/1996 | Gutgsell | A47B 9/08 108/147 |
| 5,690,303 | A | 11/1997 | Winters | |
| 6,009,815 | A | 1/2000 | Hartman | |
| 6,209,465 | B1 * | 4/2001 | Brooks | A47B 91/02 108/150 |
| 2005/0151037 | A1 | 7/2005 | Oxley | |
| 2007/0252053 | A1 | 11/2007 | Brooke | |
| 2012/0085873 | A1 * | 4/2012 | Brooke | A47B 91/16 248/188.3 |
| 2013/0036950 | A1 | 2/2013 | Heyring et al. | |

* cited by examiner

*Primary Examiner* — Matthew Ing
(74) *Attorney, Agent, or Firm* — Greenberg Traurig, LLP

(57) ABSTRACT

An integral system for stabilizing a table and chair on an uneven surface. The table comprises a table top supported by a first end of a primary shaft, a second end of the primary shaft having a first pair of legs extending therefrom; a secondary shaft positioned within, and movably joined at a first end to, the primary shaft, a second end of the secondary shaft having a second pair of legs extending therefrom; and wherein the secondary shaft may move in a side-to-side manner relative to primary shaft thereby stabilizing the table. Another version utilizes a plate member and shaft combination. Chairs may use similar technology.

15 Claims, 18 Drawing Sheets

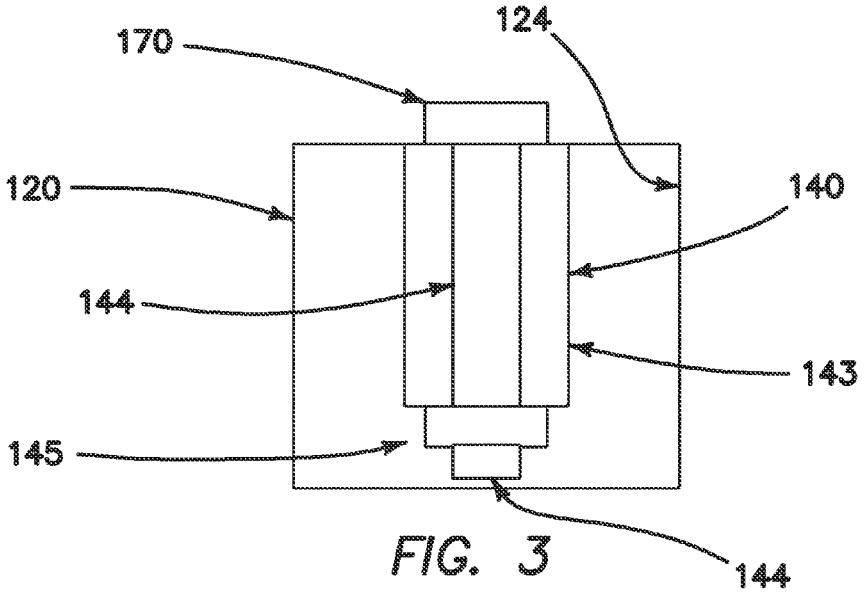
FIG. 3
FIG. 4A
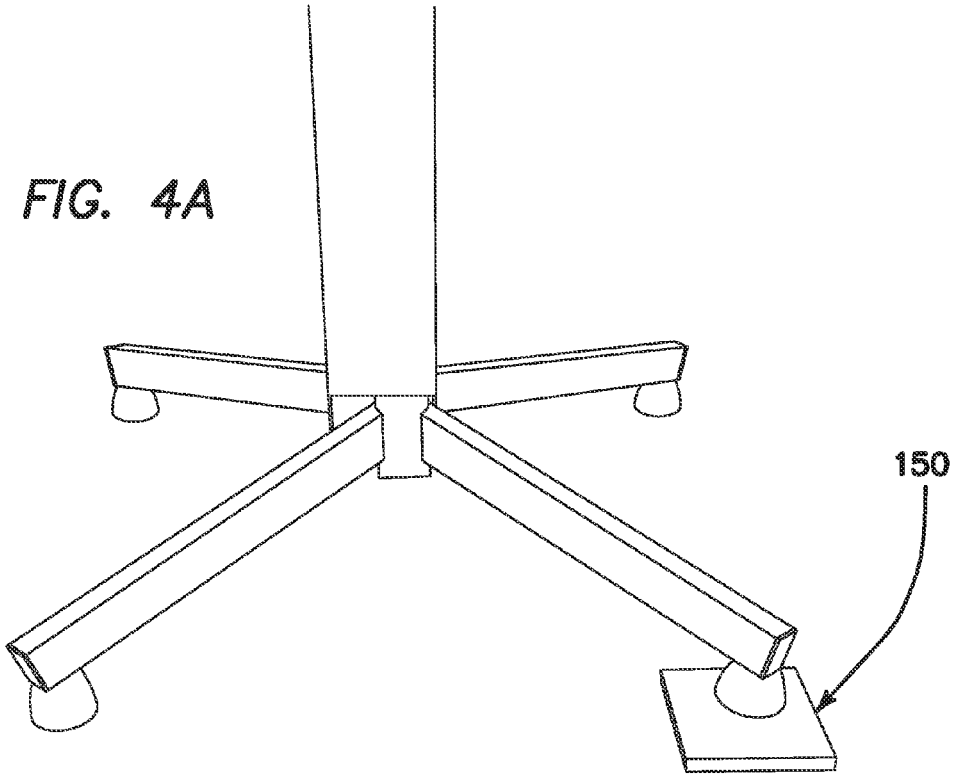

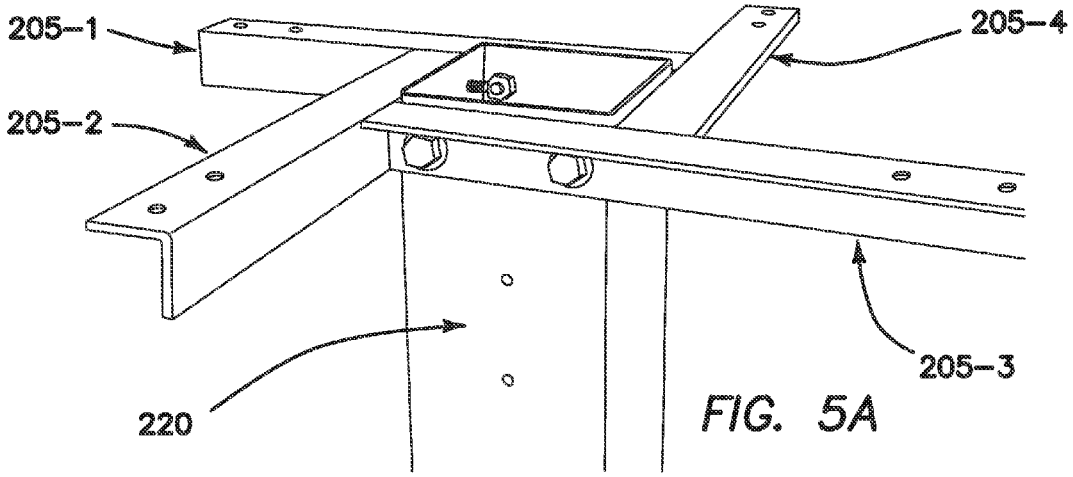
FIG. 5A
FIG. 5B
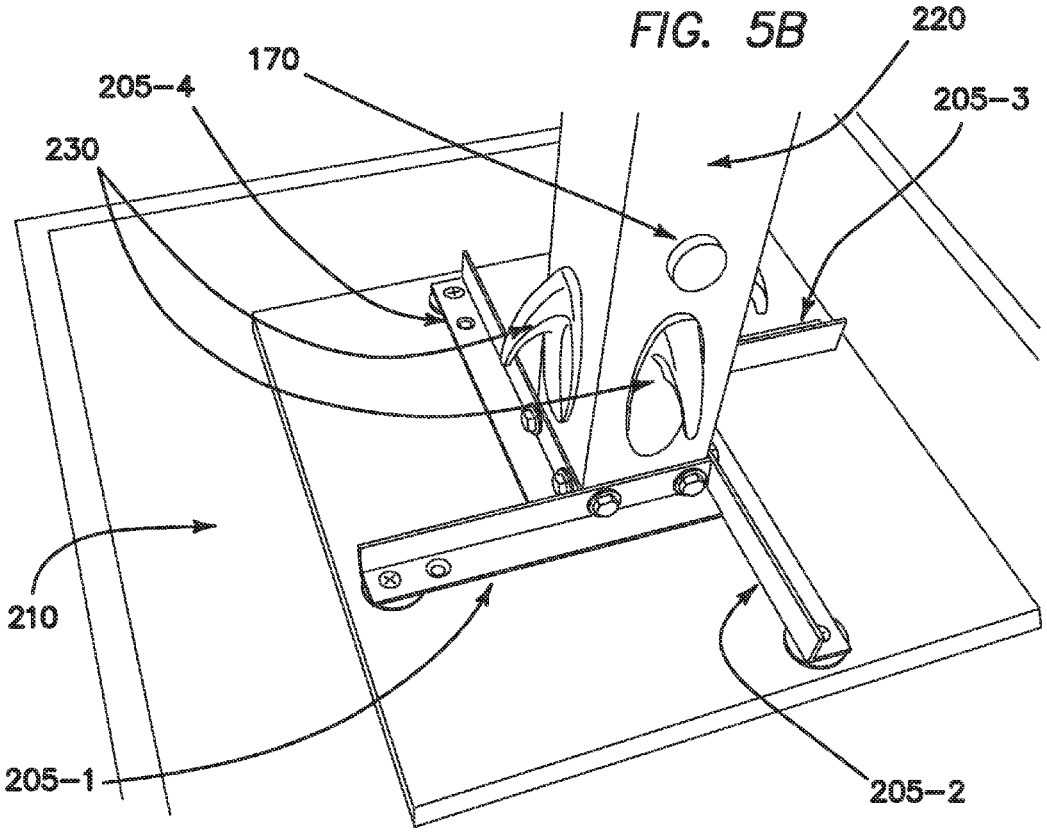

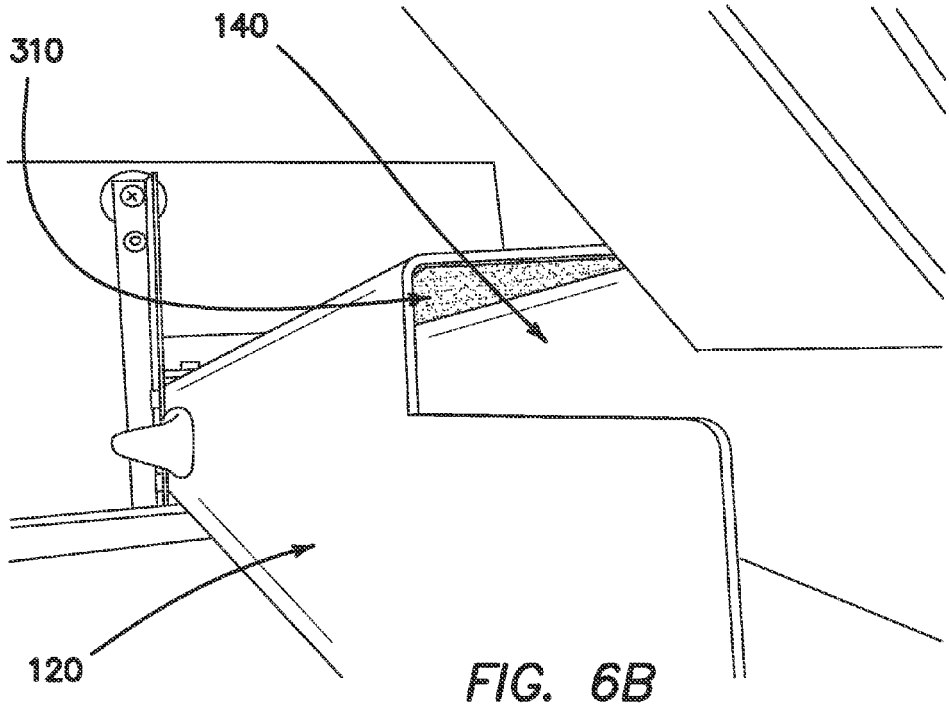
FIG. 6B
FIG. 6C
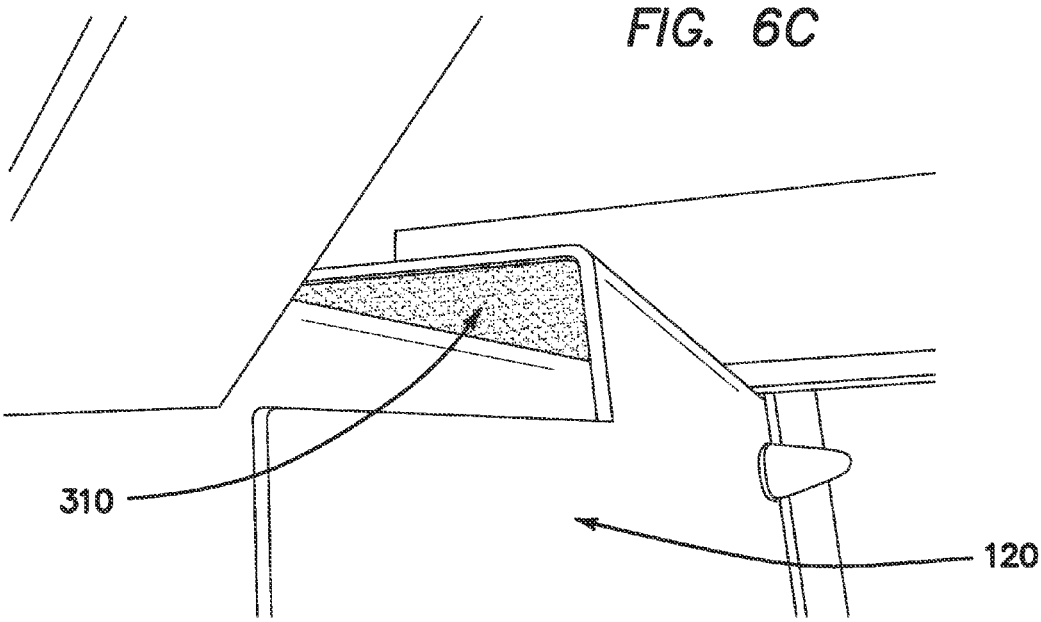

TABLE AND CHAIR WITH SELF-STABILIZING SYSTEM

CROSS-REFERENCE

This application is a continuation-in-part of, and claims priority to, U.S. patent application Ser. No. 14/653,383 filed Aug. 14, 2014 and which is incorporated herein for any and all purposes.

FIELD OF THE INVENTION

The embodiments of the present invention relate to table incorporating a self-stabilizing system for preventing a table and chair from rocking.

BACKGROUND

Table tops, especially those associated with tables used in restaurants and other commercial outlets, are ideally stable such that articles placed on a table top thereof remain steady. Moreover, a table which constantly shifts on an uneven surface is very disruptive for those seated thereabout. Solutions including the placement of folded paper under one leg of the table are simply ineffective.

Accordingly, it would be beneficial to develop a new, automatic system for stabilizing a table top associated with a table on an uneven surface.

SUMMARY

The embodiments of the present invention are directed to an integral system for stabilizing a table on an uneven surface. In one embodiment, the table comprises a table top supported by a first end of a primary shaft, a second end of said primary shaft having a first pair of legs extending therefrom; a secondary shaft positioned within, and movably joined at a first end to, said primary shaft, a second end of said secondary shaft having a second pair of legs extending therefrom; and wherein said secondary shaft may move in a side-to-side, rocking manner relative to said primary shaft thereby stabilizing said table.

In one embodiment, the connection between the secondary shaft and primary shaft may be tightened and loosened which affects the forces required to permit movement of the secondary shaft. In another embodiment, a friction-based stability system maintains the primary shaft and secondary shaft in proper position once the table is stabilized.

Other variations, embodiments and features of the present invention will become evident from the following detailed description, drawings and claims.

BRIEF DESCRIPTION OF THE DRAWINGS

FIG. 3 illustrates a top down view of said secondary shaft inserted into said primary shaft according to the embodiments of the present invention;

FIGS. 4A-4E illustrate side views of the table in use according to the embodiments of the present invention;

FIGS. 5A-5C illustrate an alternative embodiment of a self-stabilizing table according to the embodiments of the present invention;

FIGS. 6A-6C illustrate various views of a friction-based stability system according to the embodiments of the present invention;

DETAILED DESCRIPTION

Figure 1:
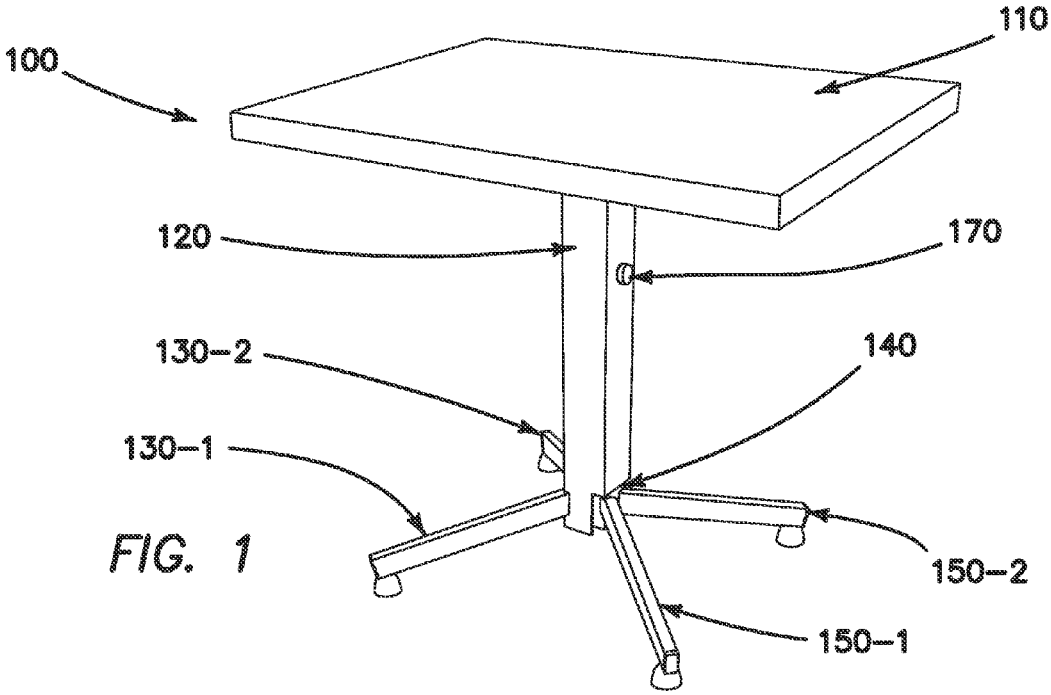
FIG. 1 illustrates a perspective view of a self-stabilizing table according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

FIG. 1 shows a perspective view of a table 100 according to the embodiments of the present invention. The table 100 comprises broadly a table top 110, primary shaft 120 having two rigid legs 130-1, 130-2 extending therefrom and a secondary shaft 140 having two swing legs 150-1, 150-2 extending therefrom. Pads 160-1 through 160-4 at the end of each of the rigid legs 130-1, 130-2 and swing legs 150-1 and 150-2 support the table 100. As detailed below, knob 170 provides means for tightening and loosening the connection between the secondary shaft 140 and primary shaft 120 influencing the movement of the secondary shaft 140 relative to the primary shaft 120. While the primary shaft 120 is shown with two rigid legs 130-1, 130-2 extending therefrom and secondary shaft 140 is shown with two swing legs 150-1 and 150-2 extending therefrom, in other embodiments, more than two legs may extend from one or both shafts 120, 140. Alternatively, a single leg may extend from one or both shafts 120, 140 wherein each single leg supports two or more legs.

Figure 2A:
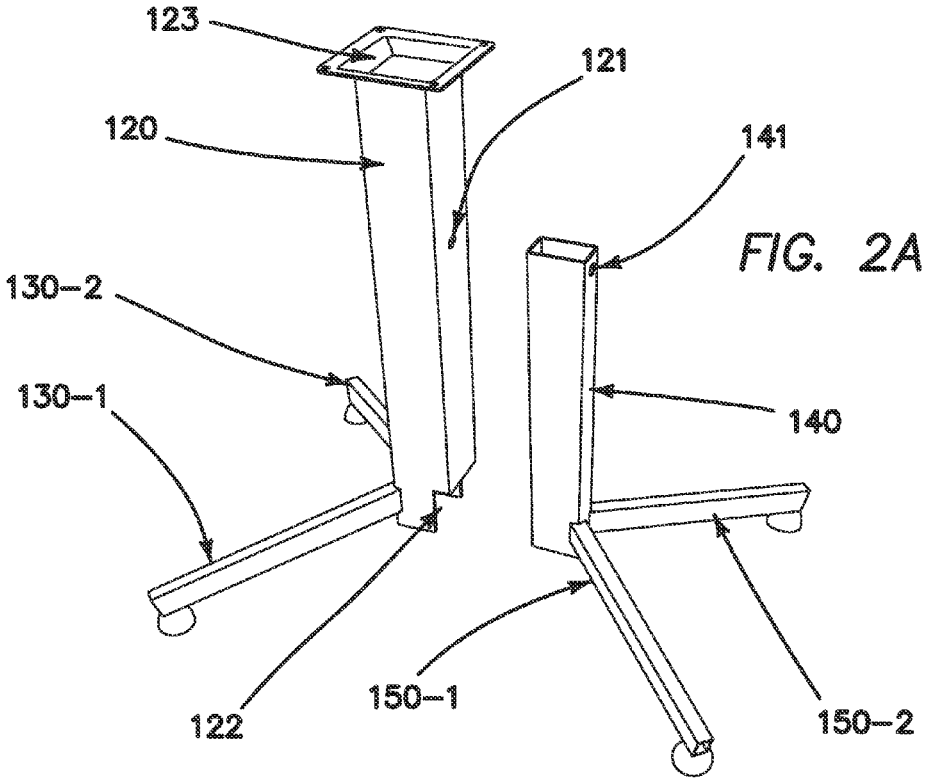
FIGS. 2A-2C illustrate various views of a primary shaft and secondary shaft according to the embodiments of the present invention.
Figure 2B:
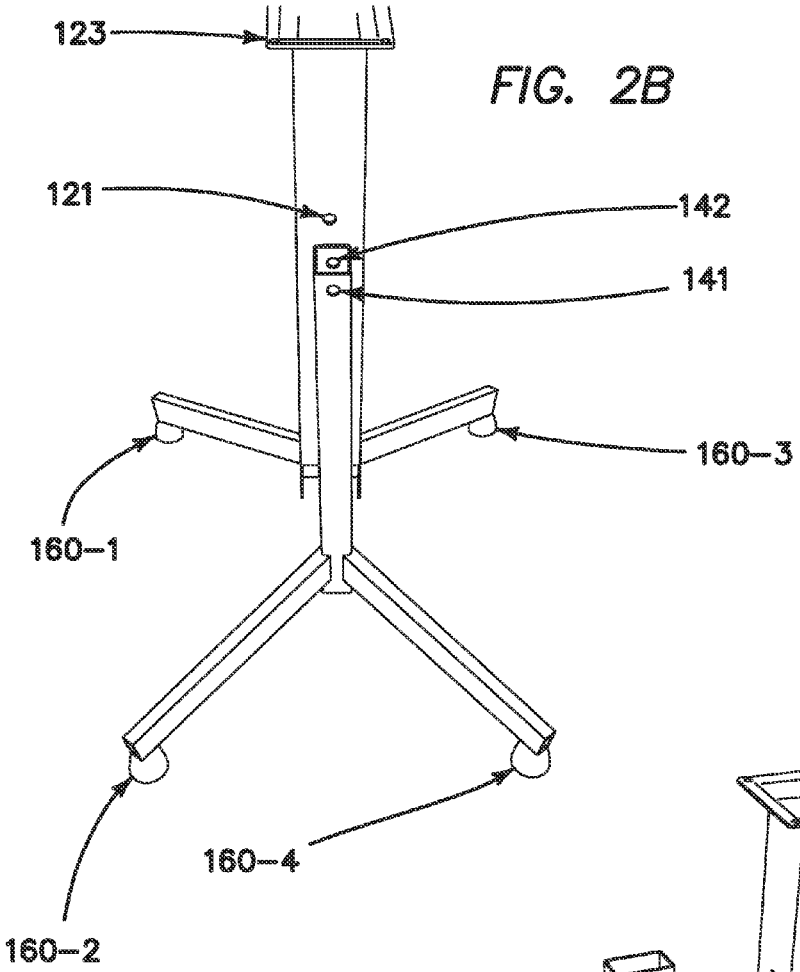
Figure 2C:
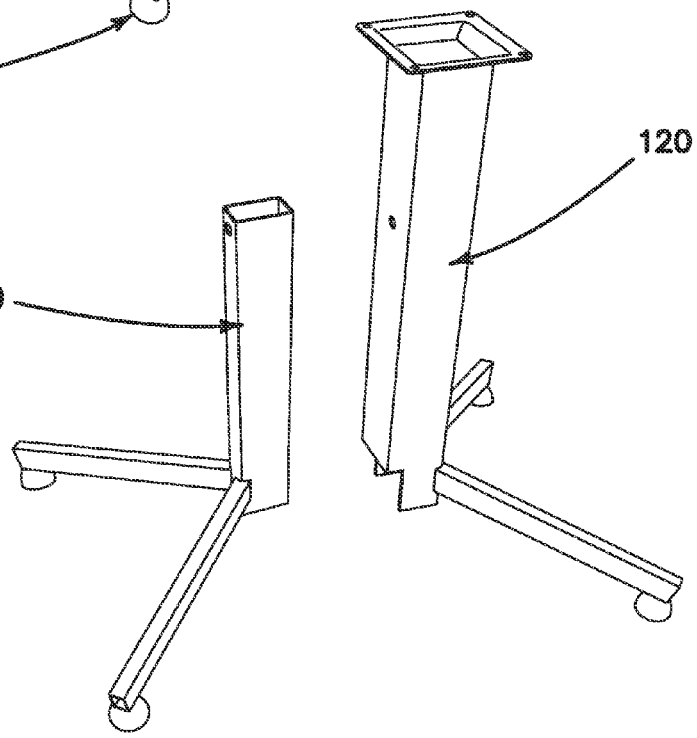

FIGS. 2A-2C show various views of a primary shaft 120 and secondary shaft 140 according to the embodiments of the present invention. The primary shaft 120 is dimensioned to permit insertion of the secondary shaft 140. As shown, the primary shaft 120 has a square cross-section while the secondary shaft 140 has a rectangular cross-section. In this manner, the secondary shaft 140 may move from side-to-side about a rotation point at the connection of the primary shaft 120 to the secondary shaft 140. The range of movement is dictated by the dimensions of the primary shaft 120 and secondary shaft 140. In one embodiment, the secondary shaft 140 is 1/16" shorter along its long edge than the sides of the primary shaft 120 creating a relatively close fit between the primary shaft 120 and secondary shaft 140 along the length of the secondary shaft 140. Those skilled in the art will recognize that the primary shaft 120 and secondary shaft 140 may take on any suitable dimensions, shapes and sizes.

FIG. 3 shows the top down view of the secondary shaft 140 inserted into the primary shaft 140. A cutout section 122 of the primary shaft 120 provides space for the legs 150-1, 150-2 extending from the secondary shaft 140.

An opening 121 in the primary shaft 120 and a pair of openings 141, 142 in the secondary shaft 140 align for the passage of a connector such a bolt 144 which accepts a nut 145 to movably join the primary shaft 120 to the secondary shaft 140 creating a rotation point for the primary shaft 120 and secondary shaft 140 relative to one another. The optional knob 170 may be used to tighten and loosen the two shafts 120, 140 to one another such that rotation is eased or restrained as desired. Other connectors may be used to join the secondary shaft 140 and primary shaft 120 to one another. In another embodiment, a bolt passes completely through the primary shaft 120 and secondary shaft such a nut is attached to the bolt on an exterior surface of the primary shaft 120.

Figure 4B:
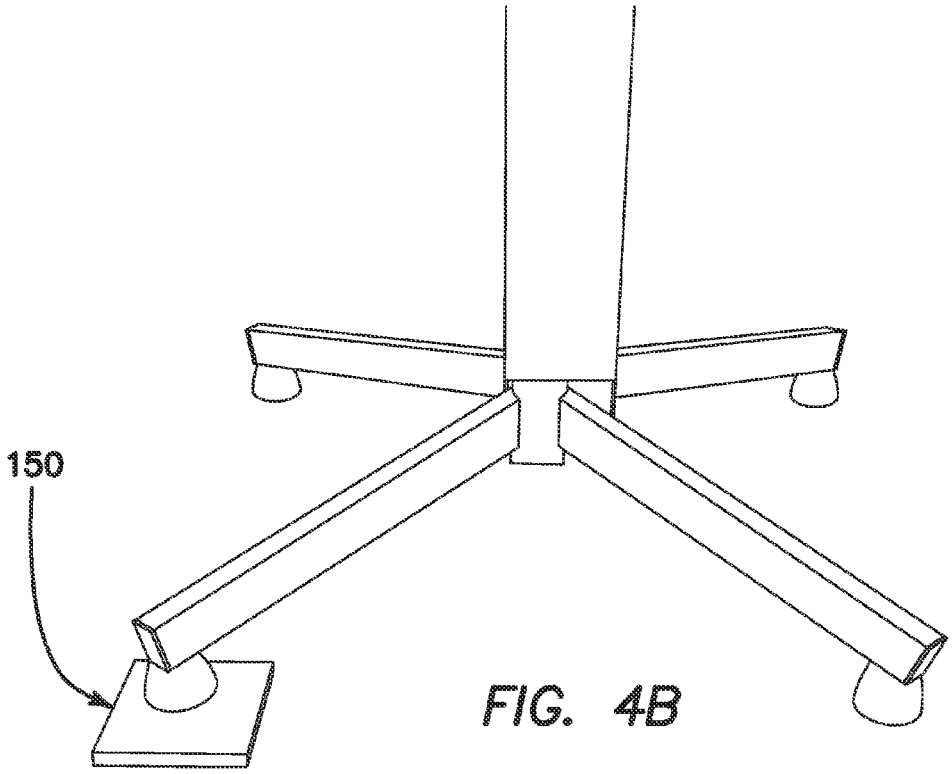
Figure 4C:
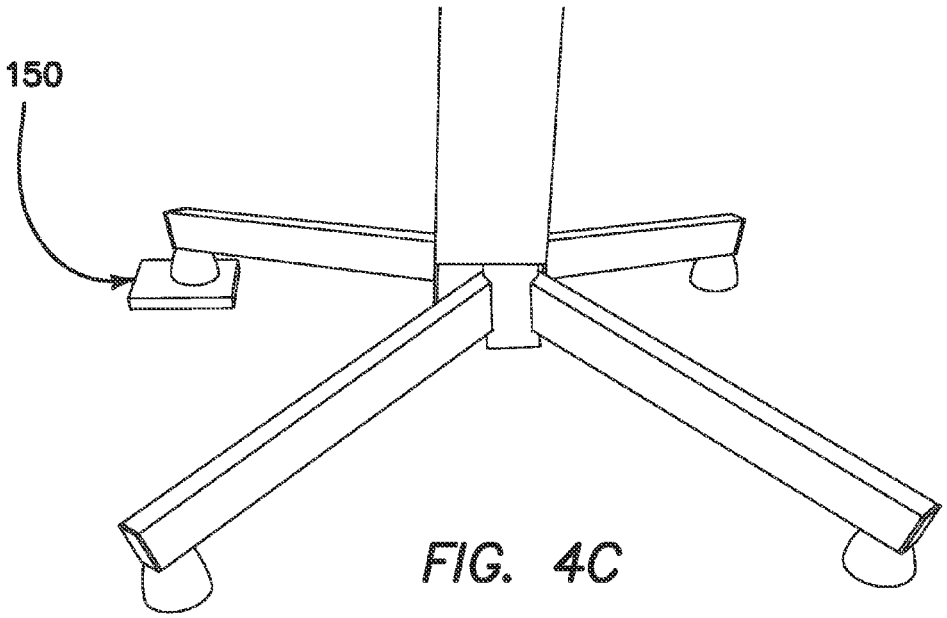
Figure 4D:
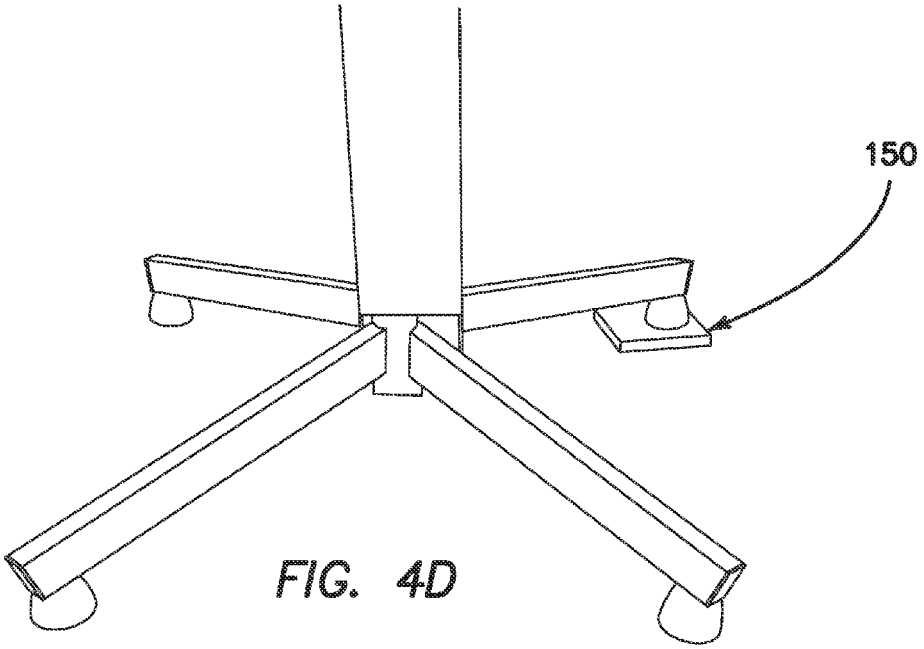
Figure 4E:
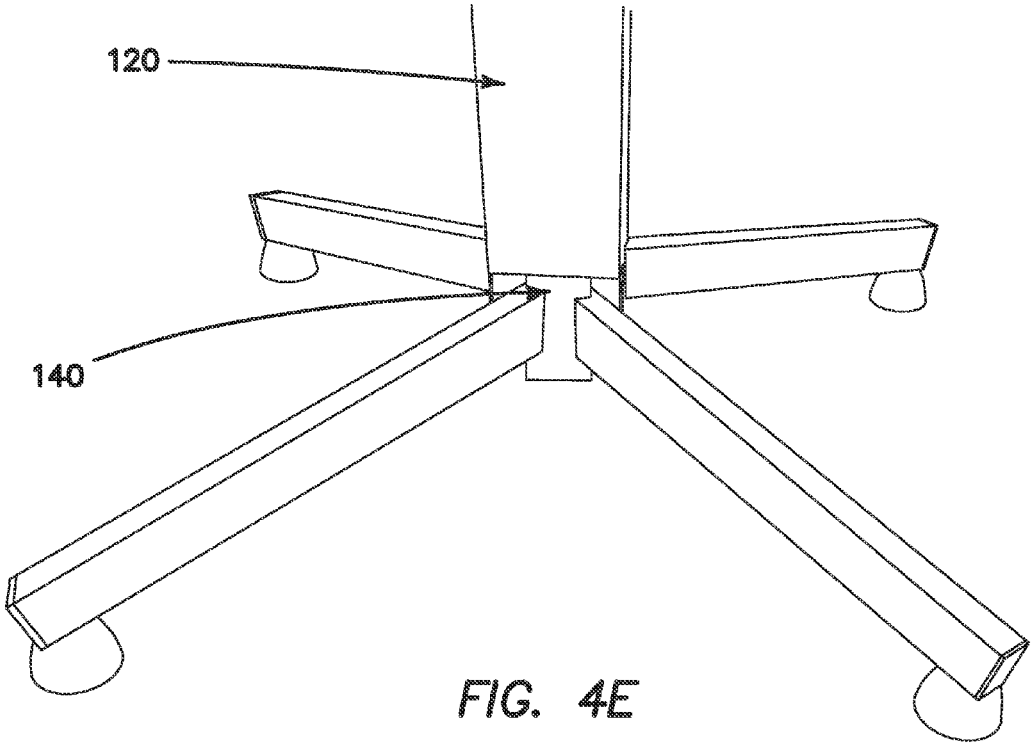

FIGS. 4A-4D illustrate side views of the table 100 in use according to the embodiments of the present invention. For purposes of reference, a piece of ⅝" plywood 105 is shown below each of the legs 130-1, 130-2, 150-1 and 150-2 representing a situation where the table 100 is on uneven surface. In each instance, the secondary shaft 140 (and swinging legs 150-1, 150-2) moves, shifts or rotates in a side-to-side (and conceivably up and down), rocking manner about the rotation point with the primary shaft 120 thereby stabilizing the attached table 100. Each of FIGS. 4A-4D shows that the secondary shaft 140 has shifted from a home position, as shown in FIG. 4E, such that one outer edge 143 of the secondary shaft 140 is nearly against an inner surface 124 of the primary shaft 120. When in the home position, the secondary shaft 140 is generally centered within the primary shaft 120 as shown in FIGS. 3 and 4E.

Figure 5C:
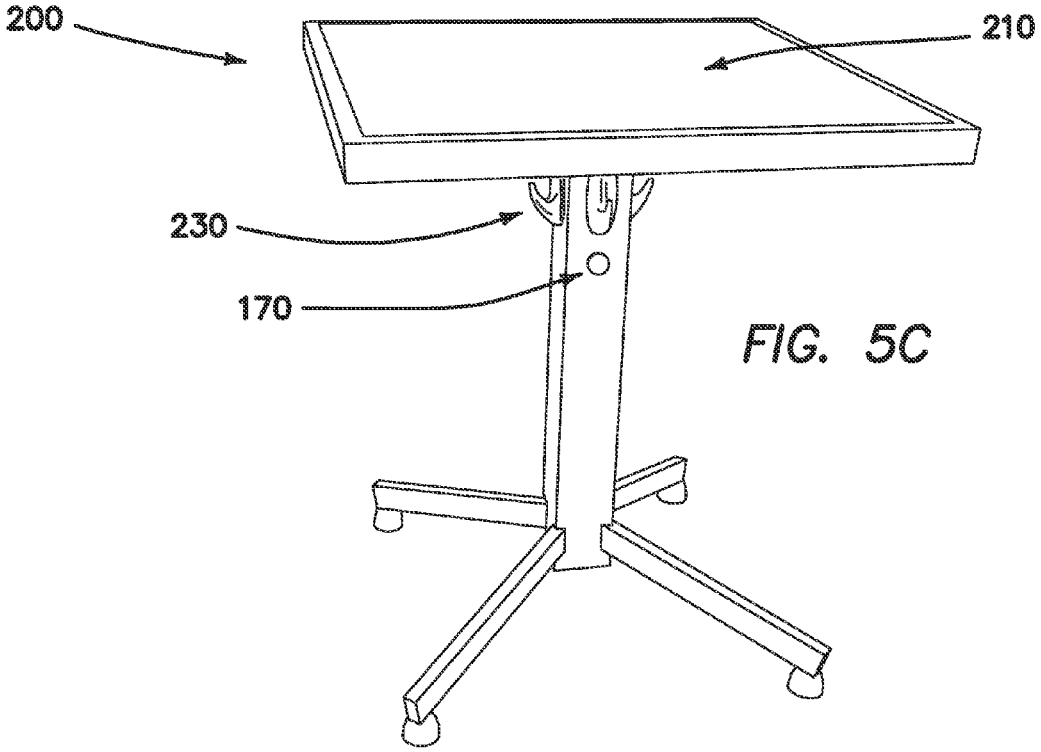

FIGS. 2A-2C show the primary shaft 120 with a platform 123 for attachment of the table top 110 thereto. FIGS. 5A-5C illustrate an alternative embodiment of a table 200 with brackets 205-1 through 205-4 for attachment of a table top 210 thereto. The brackets 205-1 through 205-4 are connected to the underside of the table top 210 and upper end of a primary shaft 220. The primary shaft 220 may also support one or more hangers 230 for receiving purses, umbrellas, shopping bags, laptop cases, etc.

Figure 6A:
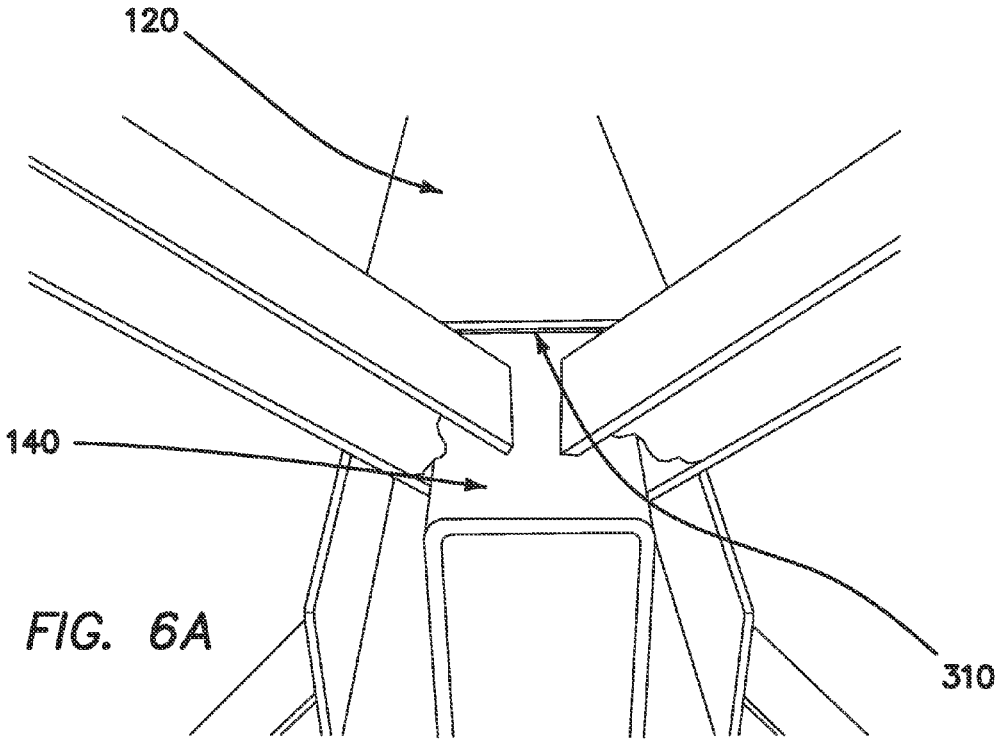

FIGS. 6A-6C illustrate various views of a friction system according to the embodiments of the present invention. As shown, the friction-based stability system comprises a rubber member 310 affixed to an inside surface of the primary shaft 120. The rubber member 310 is positioned near a bottom of primary shaft 120 so as to contact the secondary shaft 140 therein. The rubber member 310 creates friction thereby stabilizing the primary shaft 120 and secondary shaft 140 relative to one another when the table 100 is stabilized. In other words, once the primary shaft 120 has settled relative to the secondary shaft 140 on an uneven surface, the rubber member 310 serves to maintain the primary shaft 120 in place and stable despite low-impact, external activities such as contact by people seated at the table or thereabout. Other materials having high coefficients of friction may be used to create the friction-based stability system 300.

Figure 7A:
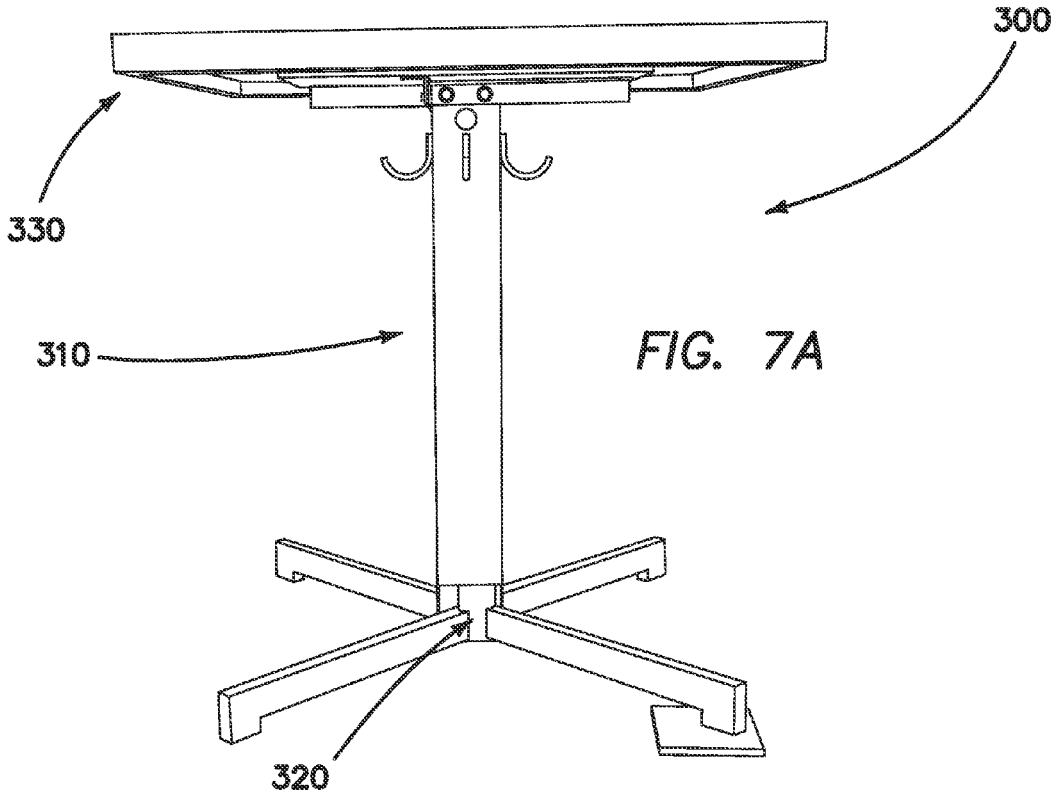
FIGS. 7A-7G illustrate various views of another embodiment of a self-stabilizing table according to the embodiments of the present invention.
Figure 7B:
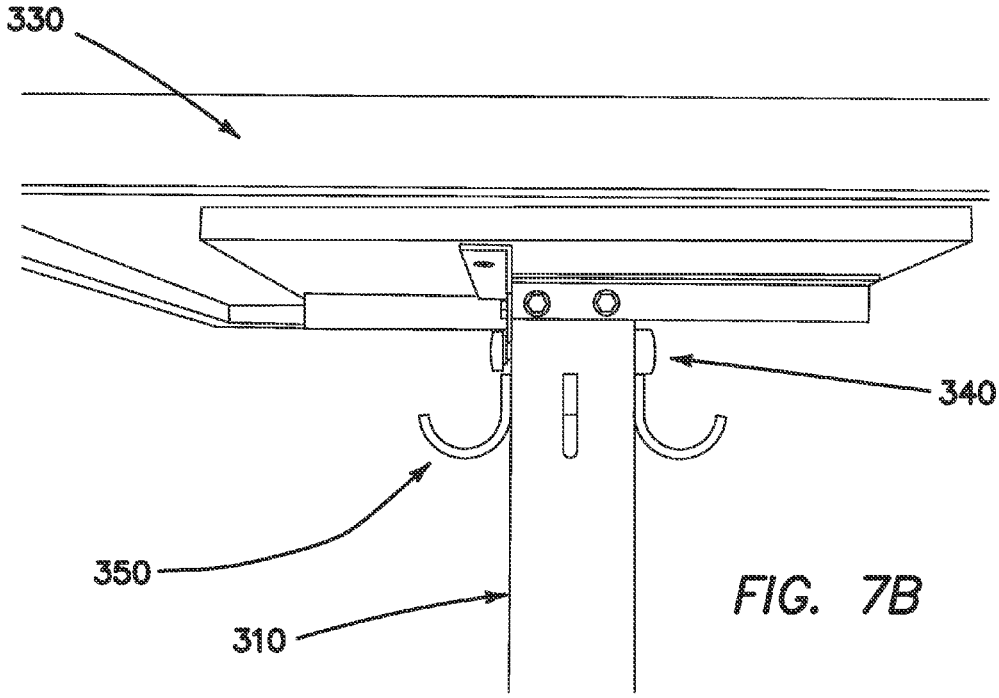
Figure 7C:
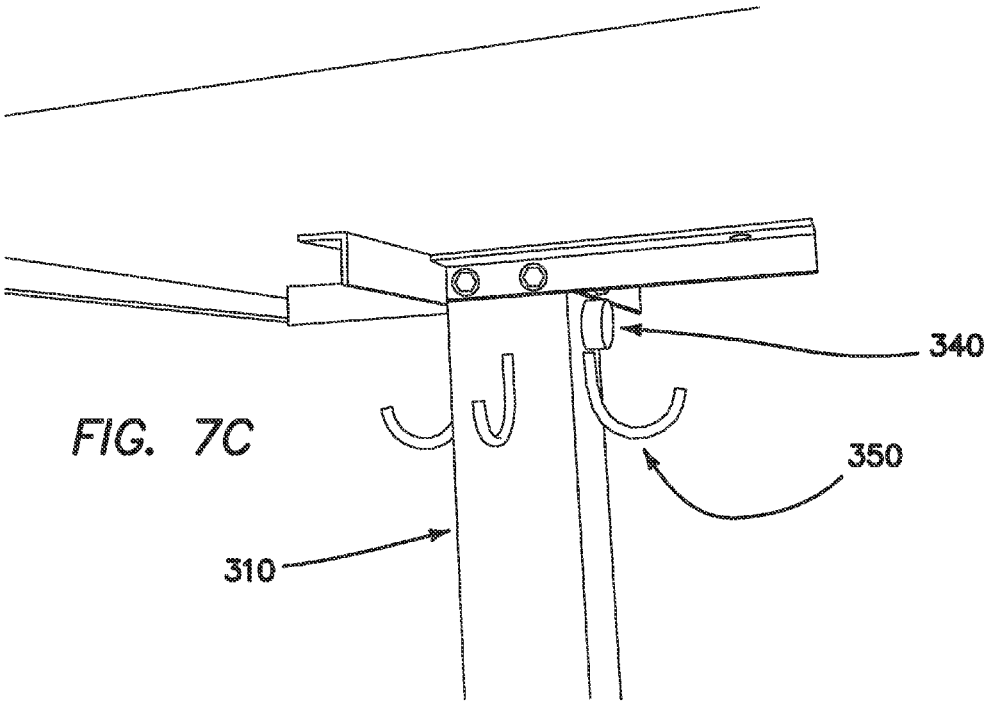
Figure 7D:
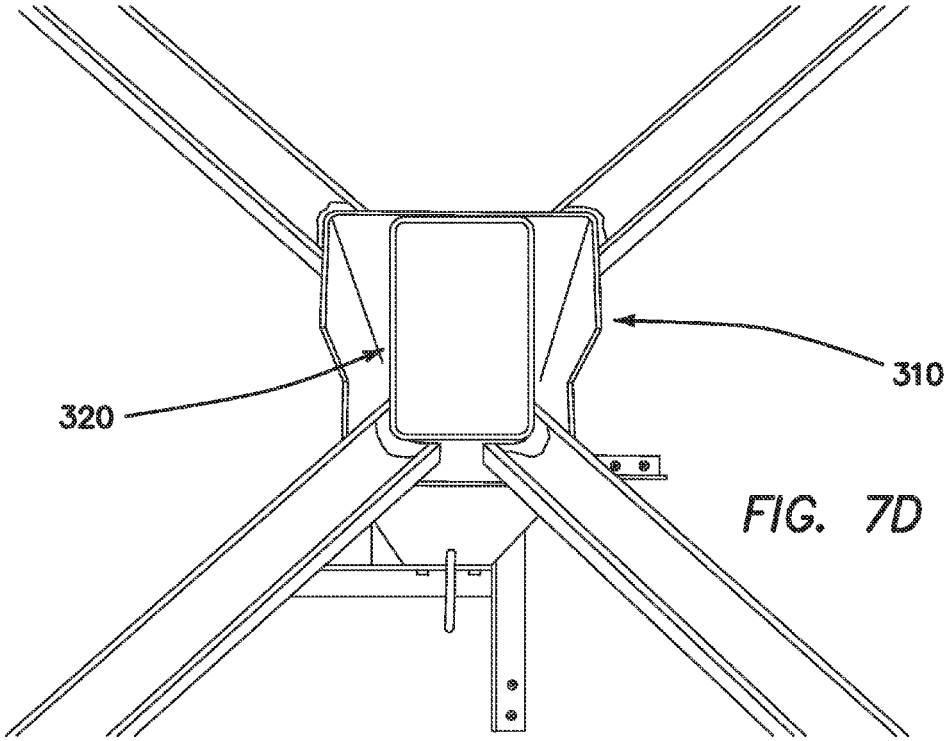
Figure 7E:
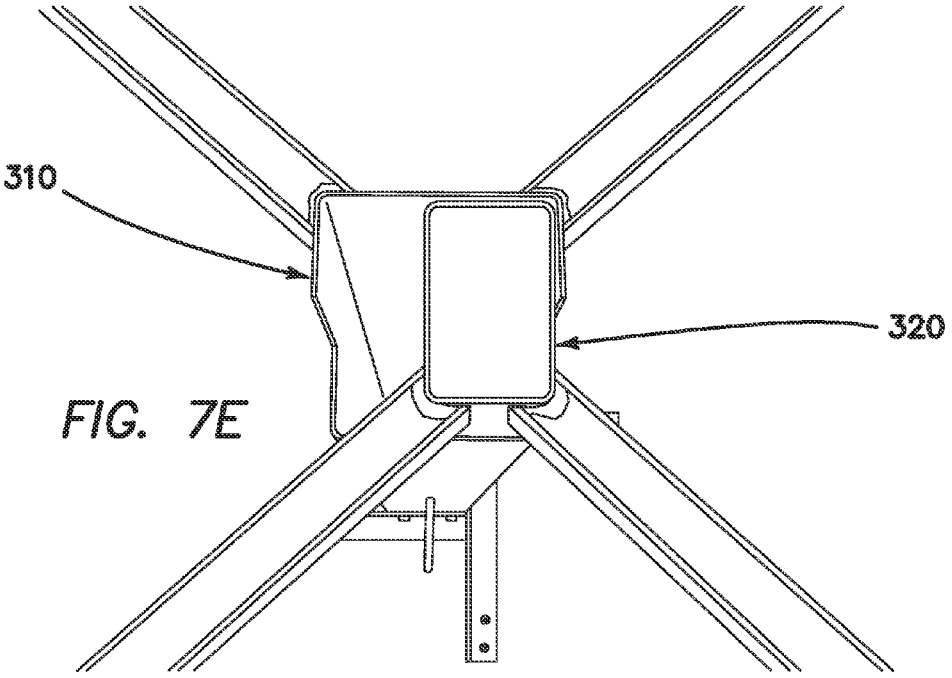
Figure 7F:
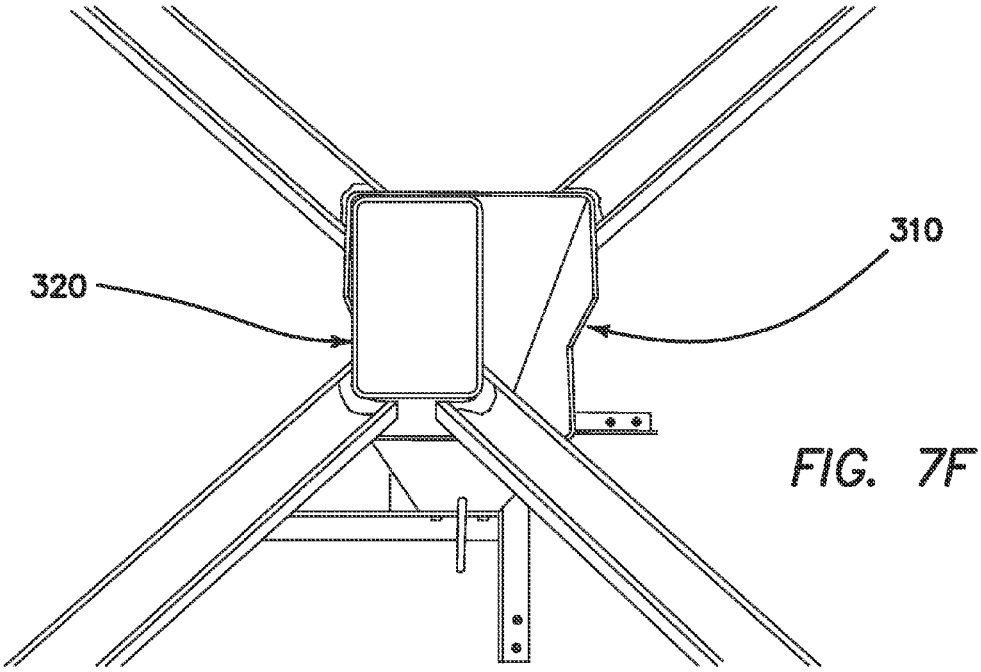
Figure 7G:
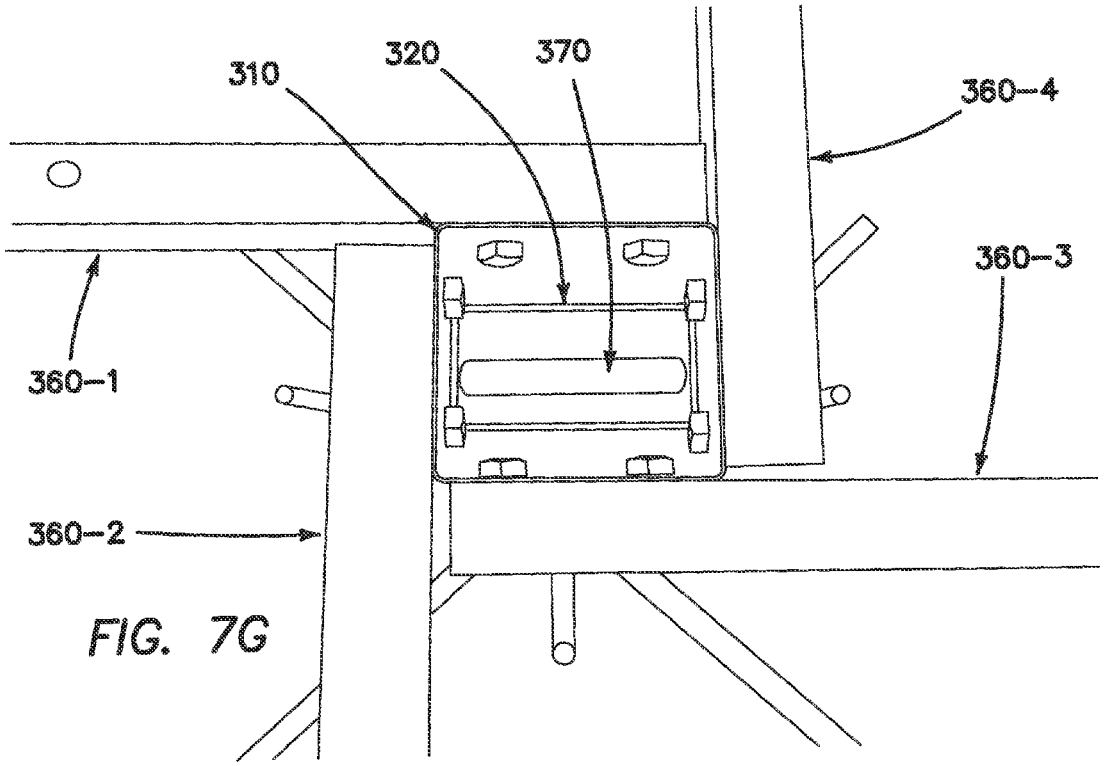

FIGS. 7A-7G show various views of another embodiment of a table 300 according to the embodiments of the present invention. As best shown in FIGS. 7A-7C, in this embodiment, the connection point of the primary shaft 310 and secondary shaft 320 is near a table top 330. Knob 340 controls the connection point. Hooks 350 provide means for hanging articles. FIGS. 7D-7F show bottom views of the table 300 with the secondary shaft 320 in a home position (center), shifted right position and shifted left position, respectively, relative to the primary shaft 310. FIG. 7G shows a top down view with the table top 330 removed. Brackets 360-1 through 360-4 support the table top 330 when it is installed. Bolt 370 joins the primary shaft 310 and secondary shaft 320 and acts as the point of rotation for the secondary shaft 320 as detailed above.

Figure 8A:
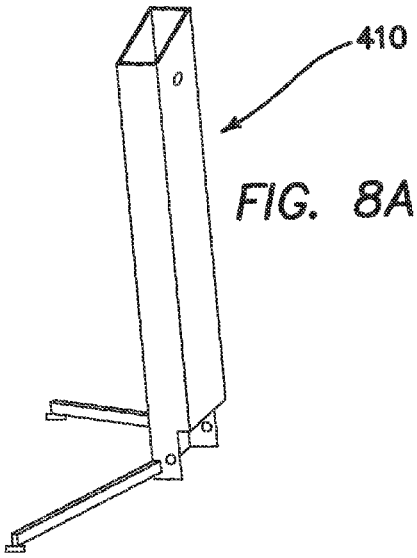
FIGS. 8A-8D illustrate various views of another embodiment of a self-stabilizing table according to the embodiments of the present invention.
Figure 8B:
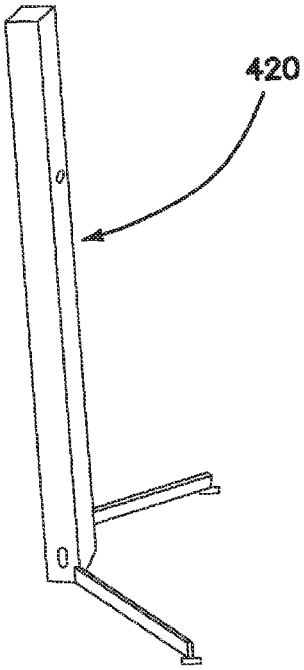
Figure 8C:
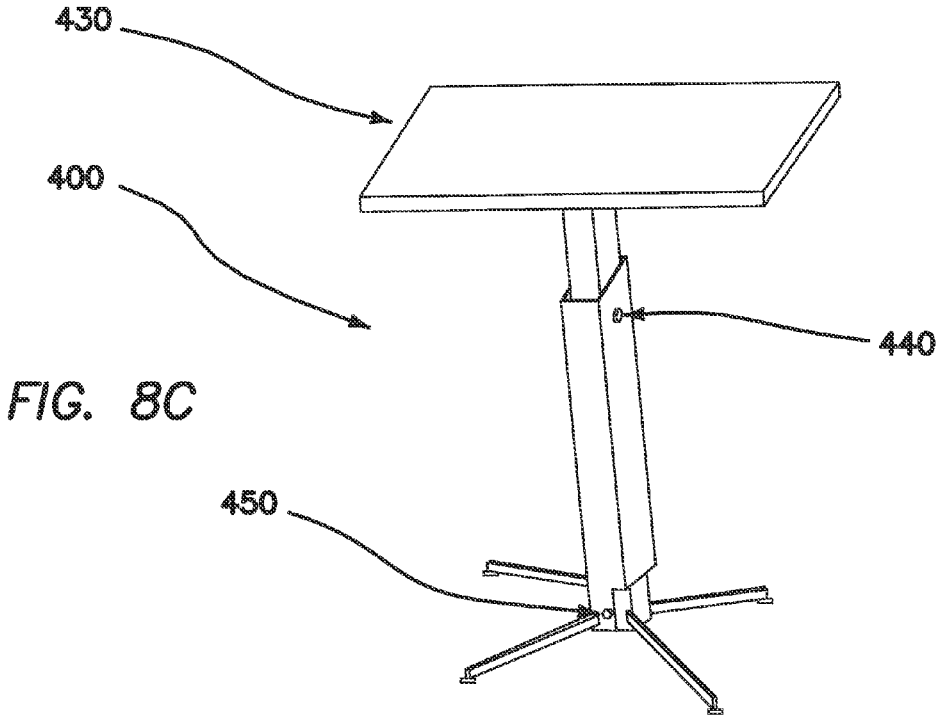
Figure 8D:
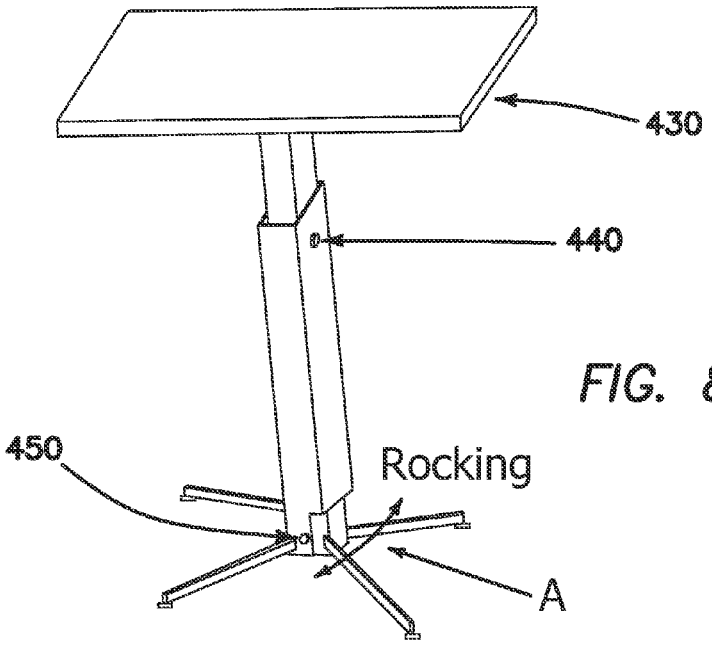

FIGS. 8A-8D illustrate various views of another embodiment of a table 400 according to the embodiments of the present invention. FIG. 8A shows a primary shaft 410 and FIG. 8B shows a secondary shaft 420. FIGS. 8C and 8D show the table 400 constructed with table top 430. FIG. 8D shows the rocking nature (Arrow A) of the secondary shaft 420 which stabilizes the table 400 when on an uneven surface. Bolt 440 joins the primary shaft 410 and secondary shaft 420 creating the point or rotation. Another bolt 450 acts to maintain the bottom of the primary shaft 410 and secondary shaft 420 to control rotation.

Figure 9A:
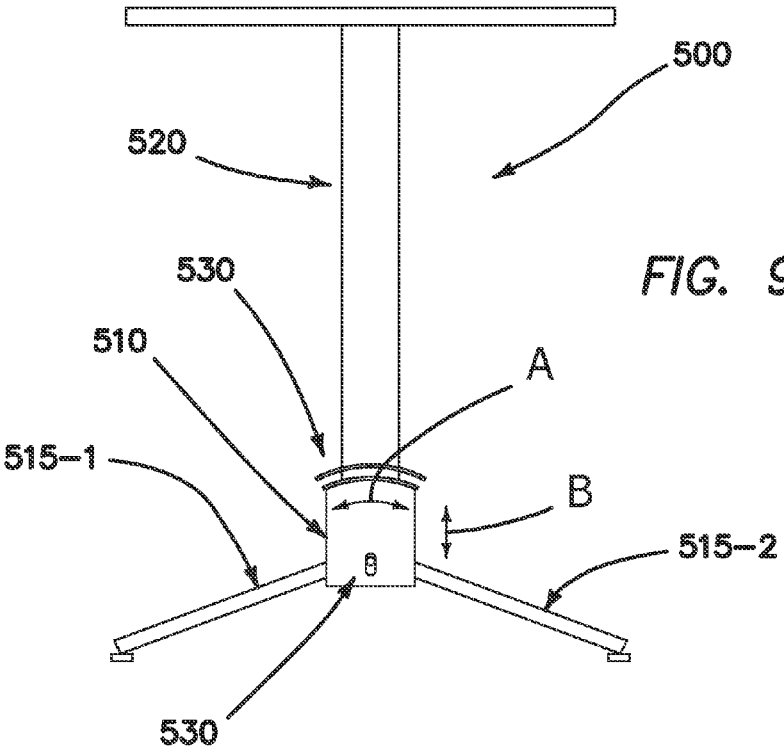
FIGS. 9A-9C illustrate various views of another embodiment of a self-stabilizing table according to the embodiments of the present invention.
Figure 9B:
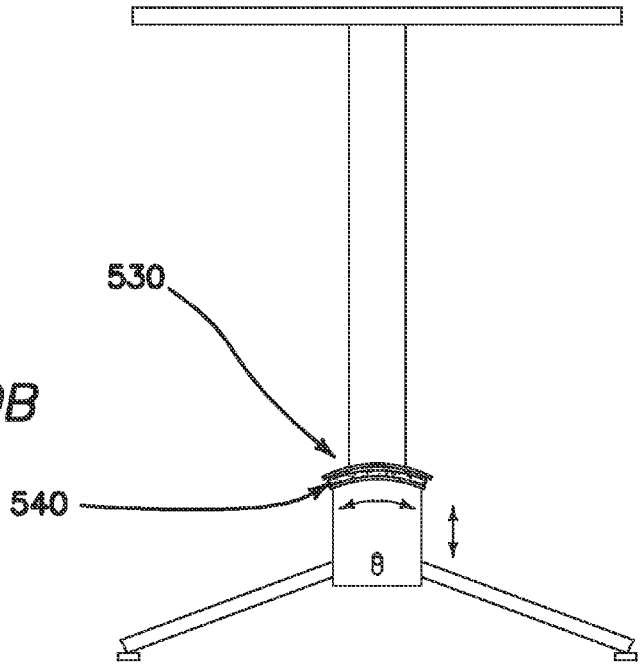
Figure 9C:
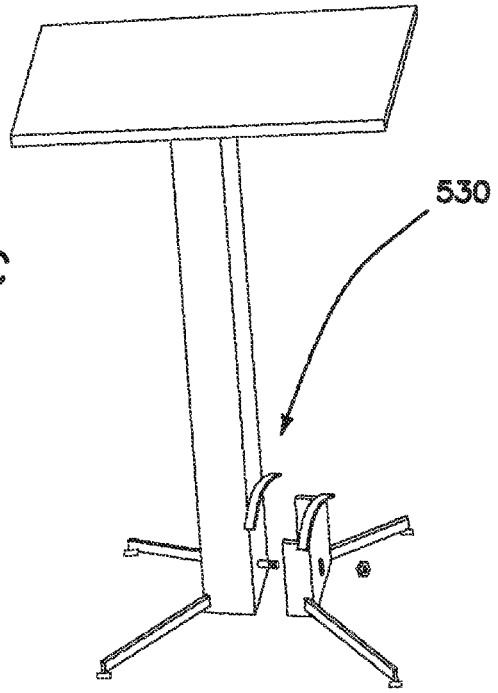
Figure 10A:
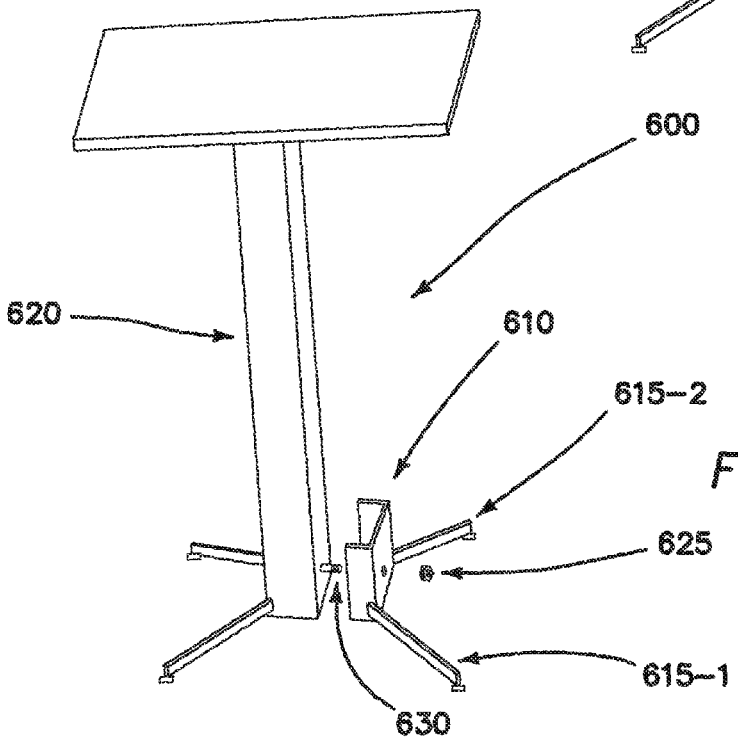
FIGS. 10A-10D illustrate various views of another embodiment of a self-stabilizing table according to the embodiments of the present invention' and FIGS. 11A-11E illustrate various views of a chair according to the embodiments of the present invention.
Figure 10B:
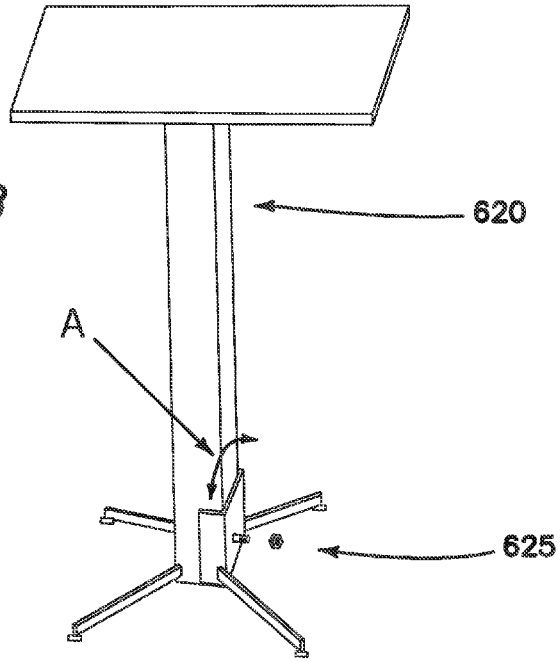
Figure 10C:
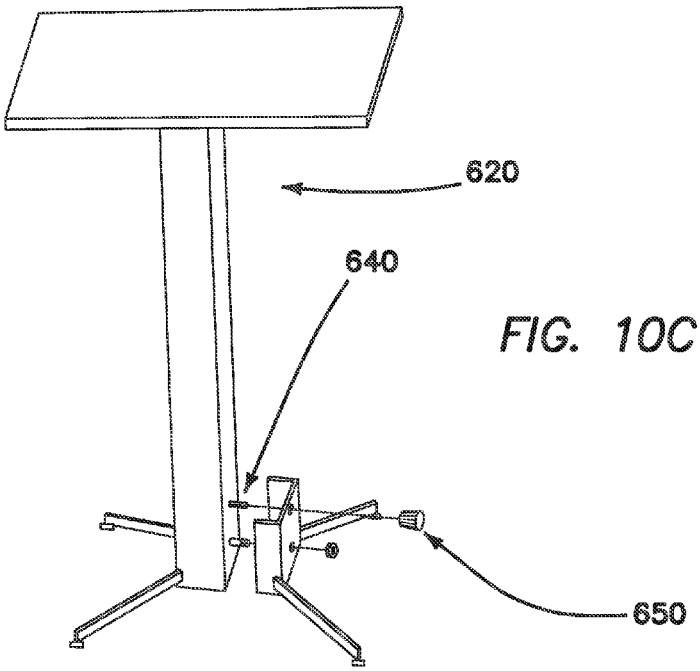
Figure 10D:
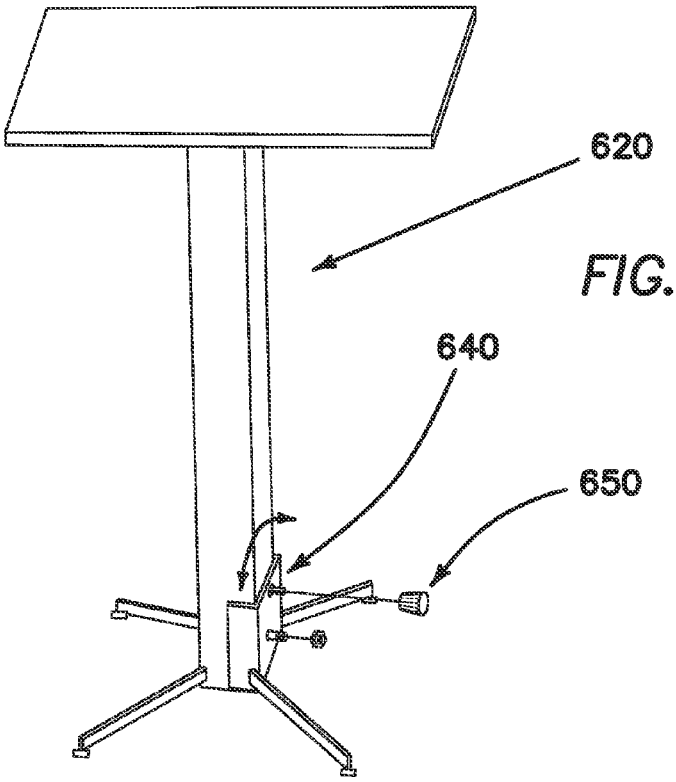
Figure 11A:
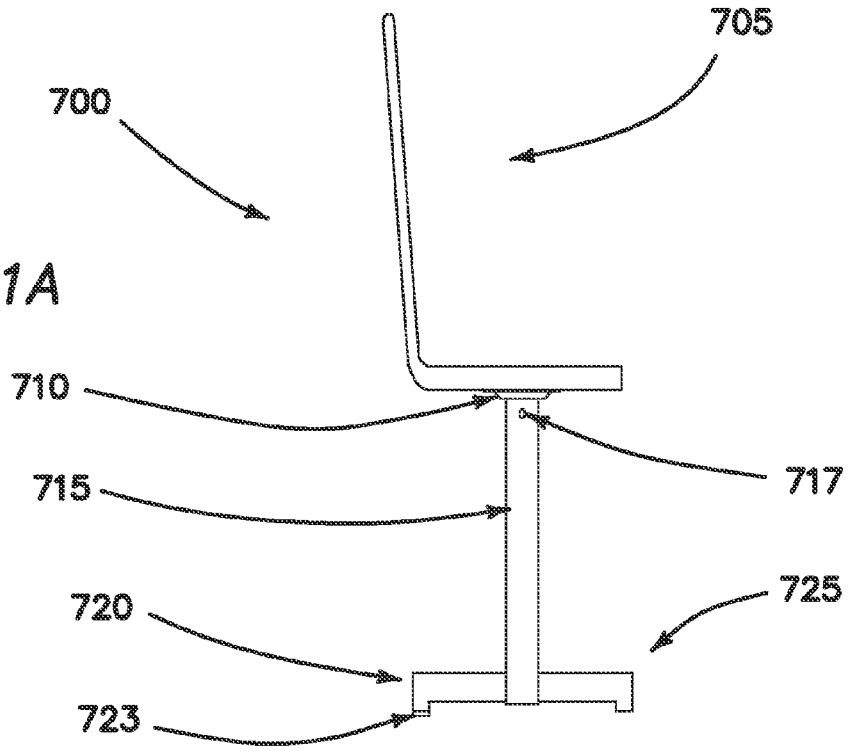
Figure 11B:
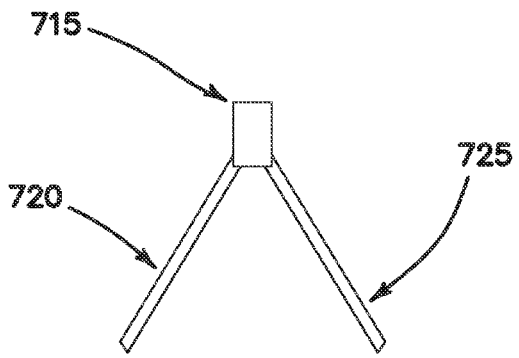
Figure 11C:
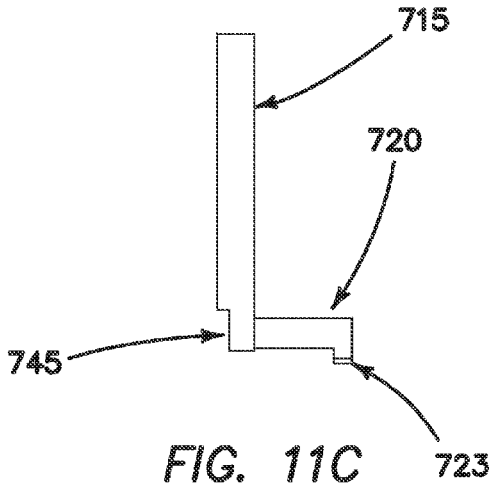
Figure 11D:
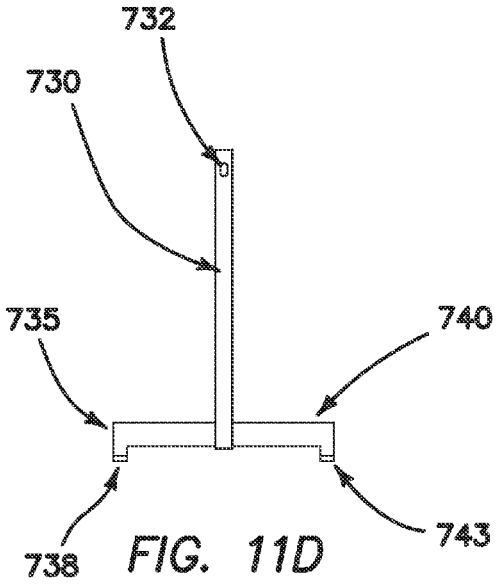
Figure 11E:
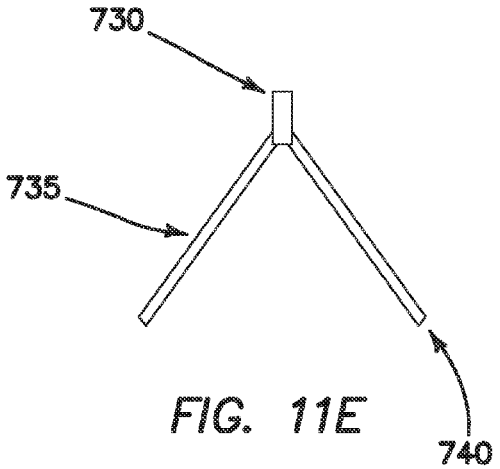

FIGS. 9A-9C illustrate various views of another embodiment of a table 500 according to the embodiments of the present invention. In this embodiment, the secondary shaft is replaced with a plate member 510 supporting two legs 515-1 and 515-2. The plate member 510 is rotatably joined to primary shaft 520 via nut 525 and bolt 530 about which the plate member 510 may rotate to stabilize the table 500 when on an uneven surface. Arrows A and B show the side-to-side and up and down directions of movement of the plate member 510. Guide 530 constrains the limits of movement of the plate member 510. An optional rubber pad 540 frictionally controls the movement of the plate member 510 in conjunction with the guide 530.

FIGS. 10A-10D illustrate various views of another embodiment of a table 600 according to the embodiments of the present invention. In this embodiment, the secondary shaft is replaced with a plate member 610 supporting two legs 615-1 and 615-2. The plate member 610 is rotatably joined to primary shaft 620 via threaded post 625 and bolt 630 about which the plate member 610 may rotate to stabilize the table 600 when on an uneven surface. Arrow A shows the side-to-side, rocking movement of the plate member 610. FIGS. 8C and 8D show a secure tie bolt 640 and secure tie knob 650 configured to further control movement of the plate member 610.

FIGS. 11A-11E show various views of a self-stabilizing chair 700 according to the embodiments of the preset invention. The chair 700 generally operates in the manner described above relative to the one or more tables detailed above. A platform and back 705 is attached, via a flange 710, to primary shaft 715. Primary shaft 715 includes two legs 720, 725. Leg 720 includes a plastic footer 723 while leg 725 does not. Secondary shaft 730 slides into primary shaft 715 and connects thereto via fasteners extending through openings 717 in primary shaft 715 and corresponding openings 732 in secondary shaft 730 forming a pivot point. Secondary shaft 730 includes two legs 735, 740 each having a footer 738, 743, respectively. In this manner, the chair 700 is able to stabilize as described above. A cut-out 745 in primary shaft 715 accommodates legs 735, 740 from secondary shaft 730.

Although the invention has been described in detail with reference to several embodiments, additional variations and modifications exist within the scope and spirit of the invention.

I claim:

1. A table comprising:

a primary shaft having a first pair of legs extending from a bottom thereof, said primary shaft having a cut-out at a bottom thereof, said cut-out opposite said first pair of legs;

a table top supported by said primary shaft; and a secondary shaft having a second pair of legs extending from a bottom thereof, said secondary shaft inserted at least partially into said primary shaft, said secondary shaft movably joined to said primary shaft about a single point of movement such that said secondary shaft may move within and relative to said primary shaft as dictated by a difference in dimensions between said primary shaft and secondary shaft, said cut-out accommodating said second pair of legs.

2. The table of claim 1 further comprising a knob for tightening and loosening the joining of the primary shaft and secondary shaft.

3. The table of claim 1 further comprising a rubber member affixed to an inside surface of said primary shaft near a point of contact with said secondary shaft.

4. The table of claim 1 wherein legs extending from said primary shaft and secondary shaft have pads.

5. The table of claim 1 wherein said primary shaft includes a bracket at a top thereof to support said table top.

6. The table of claim 1 wherein said table top is connected to said primary shaft via a series of brackets.

7. The table of claim 1 wherein said primary shaft includes one or more hooks.

8. A table comprising:

a primary shaft having a cut-out at a bottom thereof, said primary shaft configured to receive a secondary shaft therein, said secondary shaft movably attached to said primary shaft via a single attachment point such that said secondary shaft may move side-to-side within said primary shaft about said single attachment point;

a table top supported by said primary shaft;

a first pair of legs extending from a bottom of said primary shaft; and a second pair of legs extending from a bottom of said secondary shaft, said cut-out accommodating said second pair of legs.

9. The table of claim 8 further comprising a knob for tightening and loosening the joining of the primary shaft and secondary shaft.

10. The table of claim 8 further comprising a rubber member affixed to an inside surface of said primary shaft near a point of contact with said secondary shaft.

11. The table of claim 8 wherein legs extending from said primary shaft and secondary shaft have pads.

12. The table of claim 8 wherein said primary shaft includes a bracket at a top thereof to support said table top.

13. The table of claim 8 wherein said table top is connected to said primary shaft via a series of brackets.

14. The table of claim 8 wherein said primary shaft includes one or more hooks.

15. A table comprising:

a table top supported by a first end of a primary shaft having a cut-out at a bottom thereof, a second end of said primary shaft having a first pair of legs extending therefrom and opposite said cut-out;

a secondary shaft positioned within, and movably joined via a single attachment point at a first end of said secondary shaft to, said primary shaft, a second end of said secondary shaft having a second pair of legs extending from a bottom thereof, said cut-out accommodating said second pair of legs; and wherein said secondary shaft may move via said single attachment point in at least a side-to-side, rocking manner relative to said primary shaft thereby stabilizing said table when said table is on an uneven surface.

* * * * *